US005954334A

United States Patent [19]

Parker, Jr.

[11] Patent Number: 5,954,334

[45] Date of Patent: Sep. 21, 1999

[54] METHOD OF PLAYING A CARD GAME

[76] Inventor: Richard Lowell Parker, Jr., 36 Wallula Rd., Walla Walla, Wash. 99362

[21] Appl. No.: 09/016,964

[22] Filed: Feb. 2, 1998

[51] Int. Cl.[6] ..... A63F 1/00

[52] U.S. Cl. ..... 273/292; 273/303; 273/306

[58] Field of Search ..... 273/292, 303, 273/304, 305, 306

[56] References Cited

U.S. PATENT DOCUMENTS

| | | | |
|---|---|---|---|
| 357,184 | 2/1887 | Dealy | 273/306 |
| 1,117,316 | 11/1914 | Booton | 273/306 |

OTHER PUBLICATIONS

Scarne's Encyclopedia Of Games, "Bridge: Contract and Auction", pp. 118–123 and 149–154, Dec. 1973.

*Primary Examiner*—Benjamin H. Layno

[57] ABSTRACT

A card game permitting two or more players age seven to adult to participate in twenty six hands of play. Play begins with a hand of 13 cards, then 12 cards, 11 cards, and continues backwards until only one card is dealt. Play would then progress upwards from one card to thirteen before the game ends. Players earn points through a system of bidding and taking tricks which are all entered on individual score cards (Refer to FIG. 16). The player obtaining the most points is declared the winner.

1 Claim, 5 Drawing Sheets

*BACK ALLEY* *SCORECARD*

| # Cards Dealt | First Half | | | | # Cards Dealt | Second Half | | | |
|---|---|---|---|---|---|---|---|---|---|
| | Bid | Tricks | Score | Total | | Bid | Tricks | Score | Total |
| 13 | | | | | 1 | | | | |
| 12 | | | | | 2 | | | | |
| 11 | | | | | 3 | | | | |
| 10 | | | | | 4 | | | | |
| 9 | | | | | 5 | | | | |
| 8 | | | | | 6 | | | | |
| 7 | | | | | 7 | | | | |
| 6 | | | | | 8 | | | | |
| 5 | | | | | 9 | | | | |
| 4 | | | | | 10 | | | | |
| 3 | | | | | 11 | | | | |
| 2 | | | | | 12 | | | | |
| 1 | | | | | 13 | | | | |

*Players Name* *Game Score*

Figure 16

BACK ALLEY SCORECARD

| # Cards Dealt | First Half | | | | # Cards Dealt | Second Half | | | |
|---|---|---|---|---|---|---|---|---|---|
| | Bid | Tricks | Score | Total | | Bid | Tricks | Score | Total |
| 13 | | | | | 1 | | | | |
| 12 | | | | | 2 | | | | |
| 11 | | | | | 3 | | | | |
| 10 | | | | | 4 | | | | |
| 9 | | | | | 5 | | | | |
| 8 | | | | | 6 | | | | |
| 7 | | | | | 7 | | | | |
| 6 | | | | | 8 | | | | |
| 5 | | | | | 9 | | | | |
| 4 | | | | | 10 | | | | |
| 3 | | | | | 11 | | | | |
| 2 | | | | | 12 | | | | |
| 1 | | | | | 13 | | | | |
| *Players Name* | | | | | | *Game Score* | | | |

METHOD OF PLAYING A CARD GAME

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention is a card game designed for two to four players age seven to adult. (Additional players may participate by adding another deck of cards).

Although there are hundreds of card games on the market, most of these don't have "staying" power because they are for the most part ordinary. Card games come and go in the marketplace every year which indicates a desire on the public's part to have something new to stimulate their minds.

It is the purpose of the inventor to create a new and stimulating card game that would fill this need and have the staying power the public looks for.

The card game comes complete with a set of rules, two score pads, one deck of fifty six cards and a box for storage.

BRIEF SUMMARY OF THE INVENTION

This invention is a unique card game designed to offer hours of fun and enjoyment for two to four players ages seven to adult. Additional players may participate by adding another deck of cards.

This card game has been given a name that will create curiosity, Back Alley. It has a unique method of play. A different number of cards are dealt with each new hand beginning with thirteen cards, working your way backwards to one card and then back up again from one to thirteen cards. (A total of twenty six hands) The cards come in four colors, (yellow, green, blue and red) with each one containing a captivating picture (Refer to FIGS. 1 through 15) on the front which is related to the name of the game. (The picture shows an alley cat, a quarter moon, a fence, and a garbage can with trash to represent the back alley) The four wild cards (Refer to FIG. 14) offer excitement and strategy to playing the game. These wild cards are imprinted with the name, "BACK ALLEY" on their front. The back of all fifty six cards contain the words BACK ALLEY. (Refer to FIG. 15)

Players earn points through a system of bidding and taking tricks. To add mystery and chance a player may keep all the cards dealt to them or take their chances in "The back Alley" by exchanging one card from the center pile. The object of the game is to be the player with the highest score at the end of twenty six hands of play.

BRIEF DESCRIPTION OF THE SEVERAL VIEWS OF THE DRAWING

FIG. 16 is a front side view of the top page of the Back Alley Score card pad of the invention used in playing the game.

DETAILED DESCRIPTION OF THE INVENTION

Figure 1:
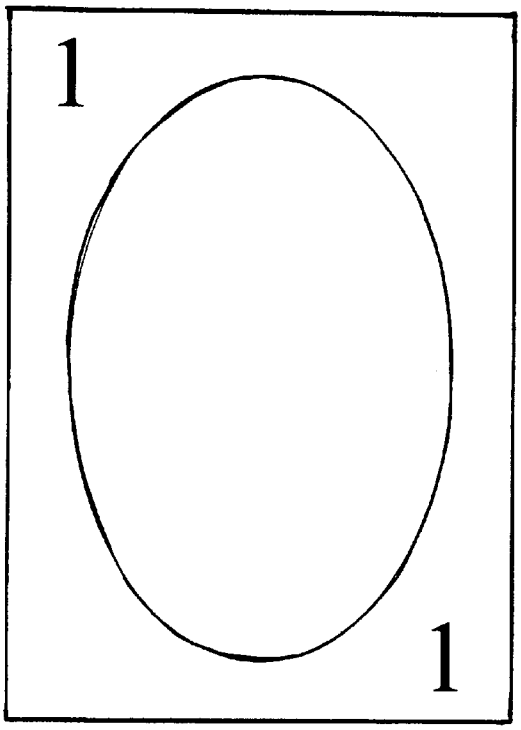
FIG. 1 is a front side view of card number one (1) of the invention used in playing the game. There are four of these cards, each a different color.
Figure 2:
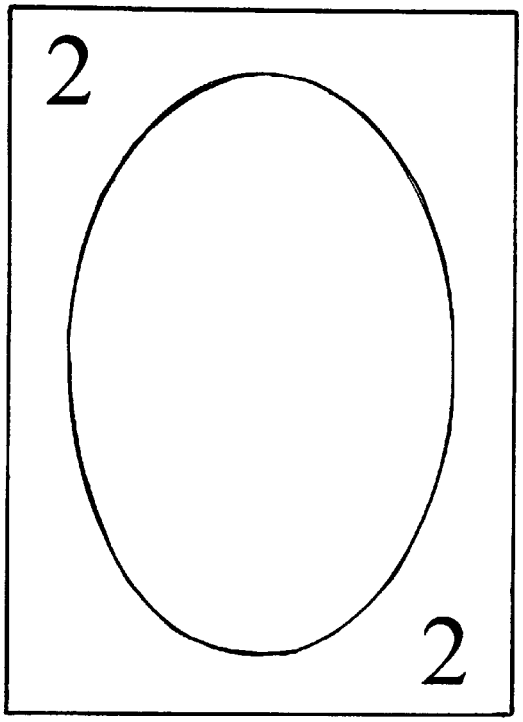
FIG. 2 is a front side view of card number two (2) of the invention used in playing the game. There are four of these cards, each a different color.
Figure 3:
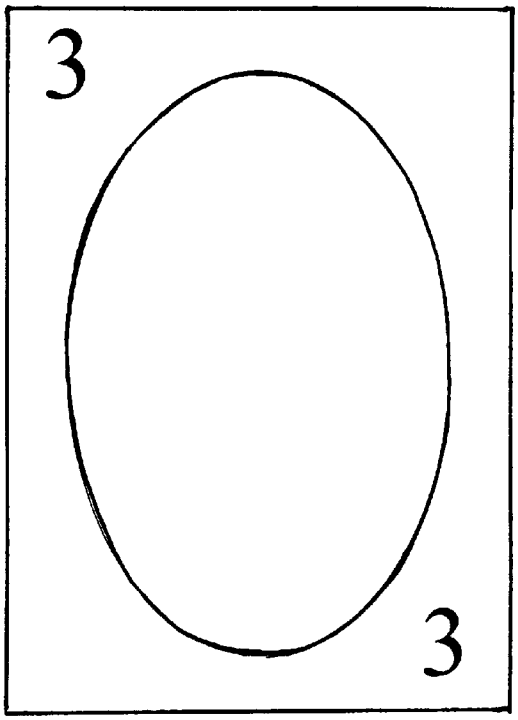
FIG. 3 is a front side view of card number three (3) of the invention used in playing the game. There are four of these cards, each a different color.
Figure 4:
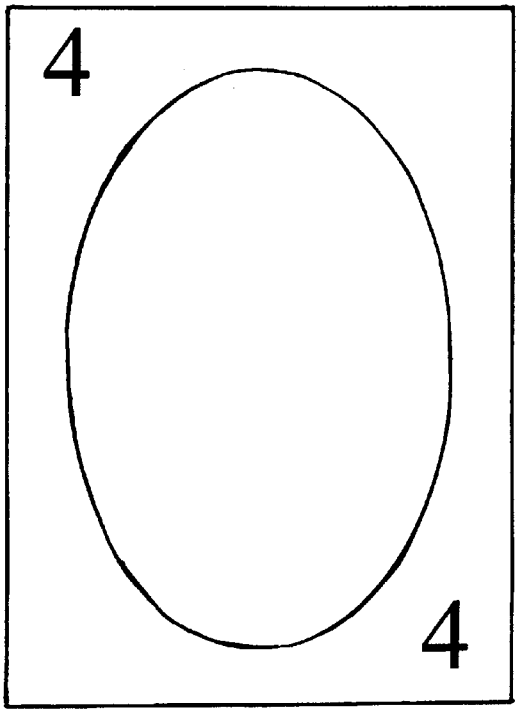
FIG. 4 is a front side view of card number four (4) of the invention used in playing the game. There are four of these cards, each a different color.
Figure 5:
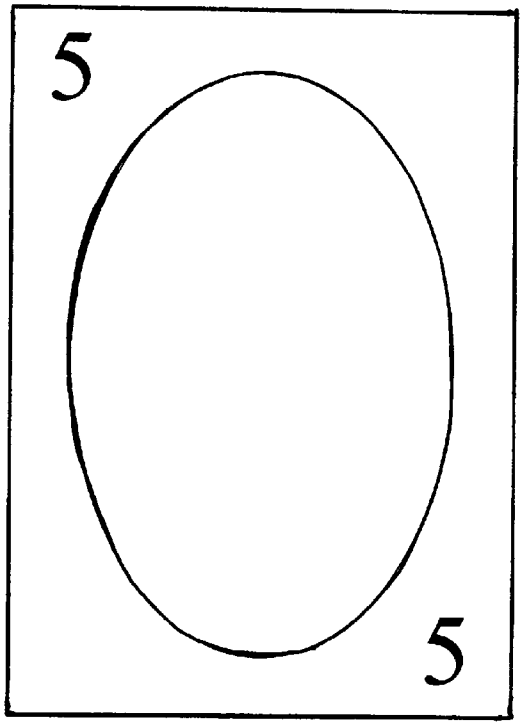
FIG. 5 is a front side view of card number five (5) of the invention used in playing the game. There are four of these cards, each a different color.
Figure 6:
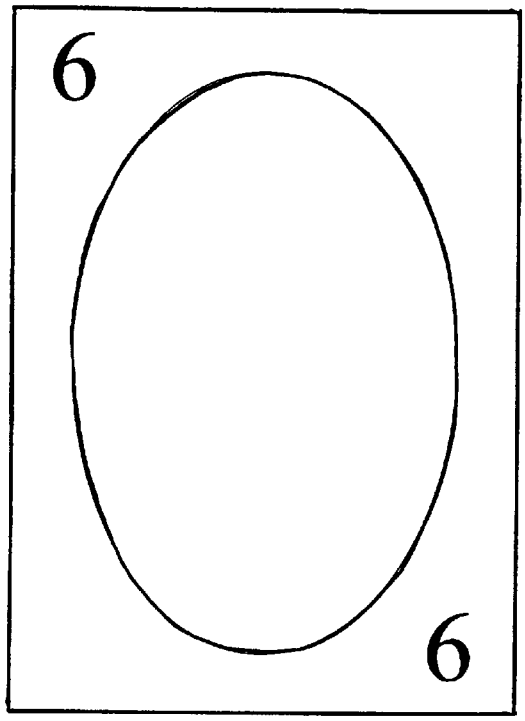
FIG. 6 is a front side view of card number six (6) of the invention used in playing the game. There are four of these cards, each a different color.
Figure 7:
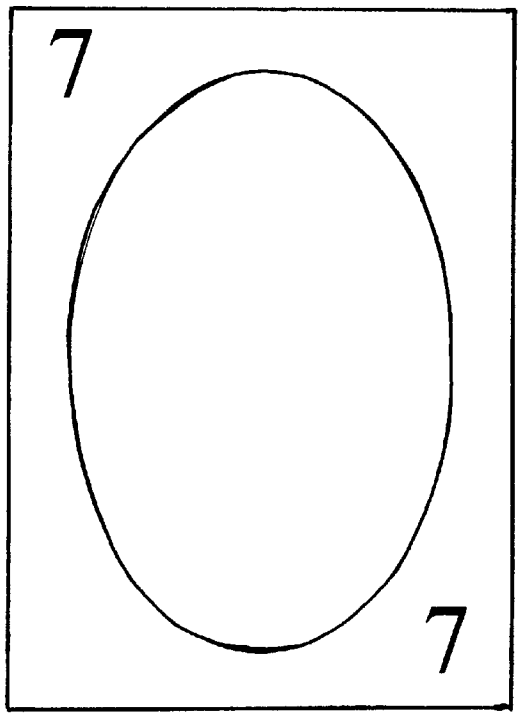
FIG. 7 is a front side view of card number seven (7) of the invention used in playing the game. There are four of these cards, each a different color.
Figure 8:
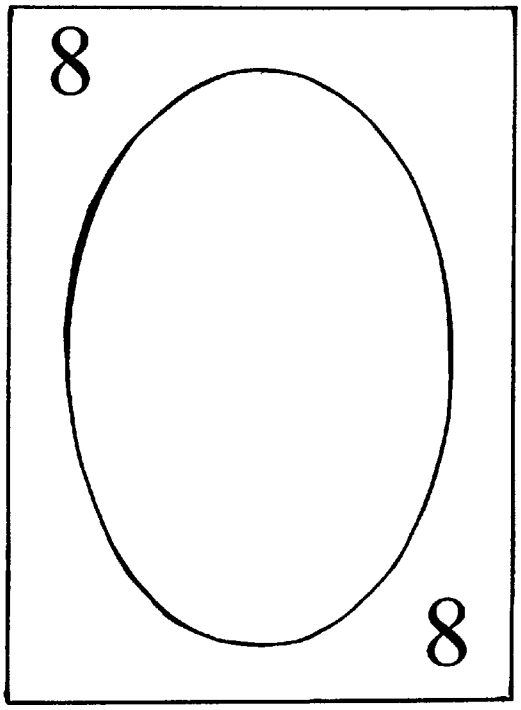
FIG. 8 is a front side view of card number eight (8) of the invention used in playing the game. There are four of these cards, each a different color.
Figure 9:
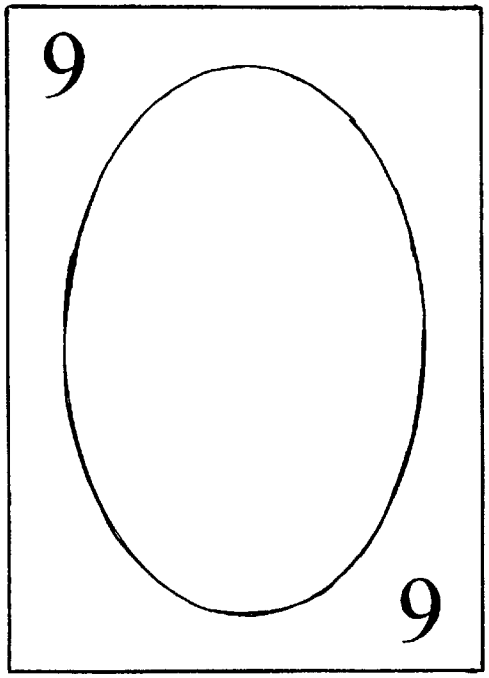
FIG. 9 is a front side view of card number nine (9) of the invention used in playing the game. There are four of these cards, each a different color.
Figure 10:
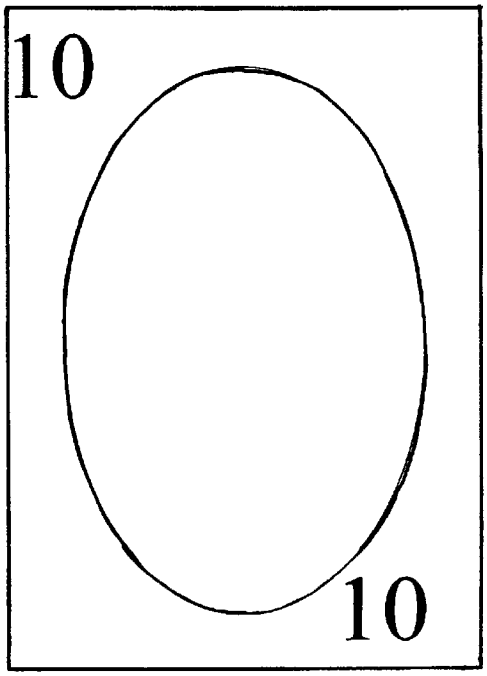
FIG. 10 is a front side view of card number ten (10) of the invention used in playing the game. There are four of these cards, each a different color.
Figure 11:
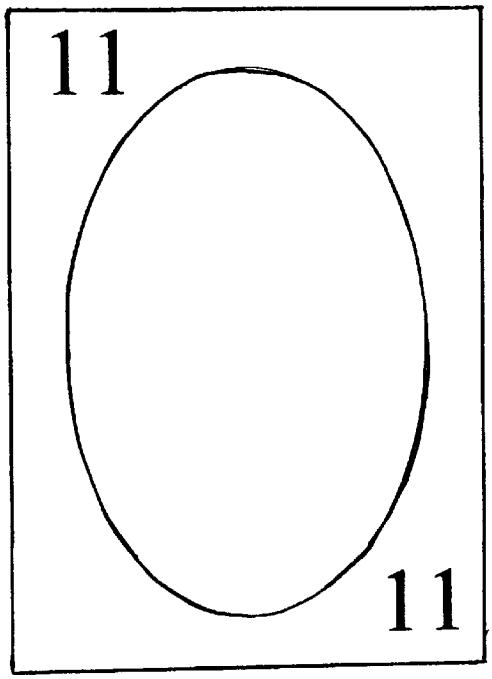
FIG. 11 is a front side view of card number eleven (11) of the invention used in playing the game. There are four of these cards, each a different color.
Figure 12:
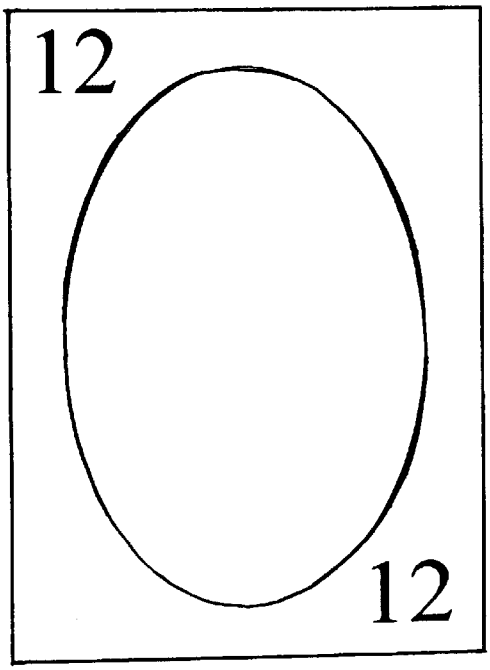
FIG. 12 is a front side view of card number twelve (12) of the invention used in playing the game. There are four of these cards, each a different color.
Figure 13:
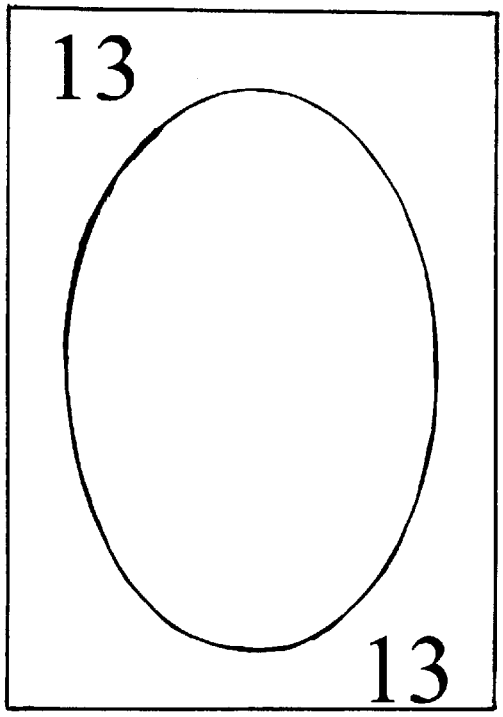
FIG. 13 is a front side view of card number thirteen (13) of the invention used in playing the game. There are four of these cards, each a different color.

This invention is an unique card game called "Back Alley", which offers hours of enjoyment for everyone ages seven to adult.

Set of rules for Back Alley, a card game:

The object of the game: The object of the game is to be the player who obtains the most points out of 26 hands of play. If a tie occurs, another hand is played.

To choose a dealer: Players draw from the unexposed pack. The player who draws the highest card deals. The deal passes to the player on the left with each new hand.

Dealing: The basic deck consists of 56 cards. 52 of the cards are numbered 1 through 13 (Refer to FIGS. 1 through 13) in each of the four different colors. (Red, blue, yellow and green.) 4 of the cards are "wild" Back Alley cards. (Refer to FIG. 14) After the deck has been shuffled and cut, the first hand of 13 cards is dealt one at a time beginning with the player to the dealer's left and then around the table clockwise. The remaining cards are always placed face down in the center of the table in a pile called the Back Alley. The second hand is dealt with only 12 cards, the third band with 11 cards, the fourth hand with 10 cards, the fifth hand with 9 cards and so on until finally only 1 card is dealt. The deal would continue with the fourteenth hand of 1 card each, the fifteenth hand with 2 cards, the sixteenth hand with 3 cards and so on. The game ends after the $26^{th}$ hand of 13 cards. Each player sorts the cards dealt to them by color and in number order.

Bidding: Players earn points through a bid system. Each player, after receiving their cards must bid the number of "tricks" they believe can be captured with their hand. Bidding begins with the dealer and passes clockwise around the table. Each player verbally states their bid to the other players and enters it on the scorecard (Refer to FIG. 16) before play begins. The amount of your bid will be determined by the number of "higher" numbered cards in your hand.

Example: In the first round of play, Player #1 is holding the following 13 cards (Refer to FIGS. 1 through 6 & 9 through 14)

Yellow 13, 9, 2, 1—you bid 1 or 2 believing the 13 & 9 will win

Green 10, 6, 3—you bid 1 believing the 10 will win

Blue 11—you bid 0 believing you will lose this card

Red 13, 12, 5, 4—you bid 1 or 2 believing the 13 & 12 will win

"Wild" Back Alley card—you bid 1 believing the wild card will win

Tricks: A trick consists of all cards played in one hand. The player who plays the highest card in one round of play takes the trick. (A trick is simply one hand taken.)

Example: (Refer to FIGS. 1, 6, 9 & 12)

Player #1 leads a yellow 9

Player #2 follows with a yellow 1

Player #3 plays a yellow 12

Player #4 plays a yellow 6

This trick was taken by player #3.

When a trick is taken, those cards should be placed in front of you and kept separate to be totaled at the end of that hand.

Playing: After each player has bid, the player to the left of the dealer begins by playing any number card, of any color, to the center of the table. Play passes to the left, each player in turn playing one card. After each player has played one card in turn, the player with the highest card of the color led takes all the cards played. This is called "taking a trick". However, if a player plays any "Wild" Back Alley card (Refer to FIG. 14), the trick would go to that player. The game continues with the player who took the last trick leading the next card.

Note: A player must follow the color lead if possible. If a player does not have a card of the color lead, a "Wild" Back Alley card (Refer to FIG. 14) must be played. If however they have neither the correct color or a "Wild" Back Alley card (Refer to FIG. 14), they must then play any card of any color. All cards are shuffled after each round is played.

Wild cards: There are four "Wild" Back Alley cards (Refer to FIG. 14). Wild cards can only be played when you are unable to follow the play with the same color which was lead. You are not allowed to lead a Wild card unless it is the last hand of any round of play. The first wild card played in a hand takes the trick. Once a wild card is played, the other players are no longer required to follow the color and may play any other color in their hand.

The Back Alley: The Back Alley consists of those cards remaining after each hand is dealt. These cards are placed face down in the center of the table. After all cards are dealt and before bidding, each player may exchange one card in their hand for a card in the Back Alley. All cards are drawn from the top of the face down deck beginning with the person on the dealer's left and around the table clockwise. The card exchanged remains in the Back Alley on the bottom.

Scoring: Each "trick" has a value of 3 points up to the amount of your bid. Each trick which exceeds your bid has a value of 1 point. If the tricks you take are less than the amount of your bid, you must subtract 3 points for each trick not captured. This will result in a minus score and a forfeiture of those tricks taken. Remember to enter your bid on your scorecard (Refer to FIG. 16) before play begins. After each hand is played, players will total the "tricks" captured and enter this number on their scorecard. (Refer to FIG. 16)

Example: Player #1 bid four and captured six. A score of fourteen (twelve points for each correct bid and two points for the extra tricks.)

Player #2 bid three and captured three. A score of nine. (Three points for each correct bid).

Player #3 bid five and captured five. A score of fifteen. (Three points for each correct bid).

Player #4 bid two and captured one. A score of minus three. (Three points subtracted for each trick not captured). The one trick captured is forfeited.

Extra players: Add one additional deck of cards (Refer to FIGS. 1 through 15) for one to four more players with one small rule change. When duplicated cards are played, such as two blue 13's (Refer to FIG. 13), the first card played takes the trick.

Game contents:

One official Back Alley set of rules.

Two Back Alley score pads (Refer to FIG. 16)

One deck of 56 cards, containing:

13 yellow cards numbered 1 to 13 (Ref. FIGS. 1–13 & 15)

13 green cards numbered 1 to 13 (Ref. FIGS. 1–13 & 15)

13 red cards numbered 1 to 13 (Ref. FIGS. 1–13 & 15)

13 blue cards numbered 1 to 13 (Ref FIGS. 1–13 & 15)

Figure 14:
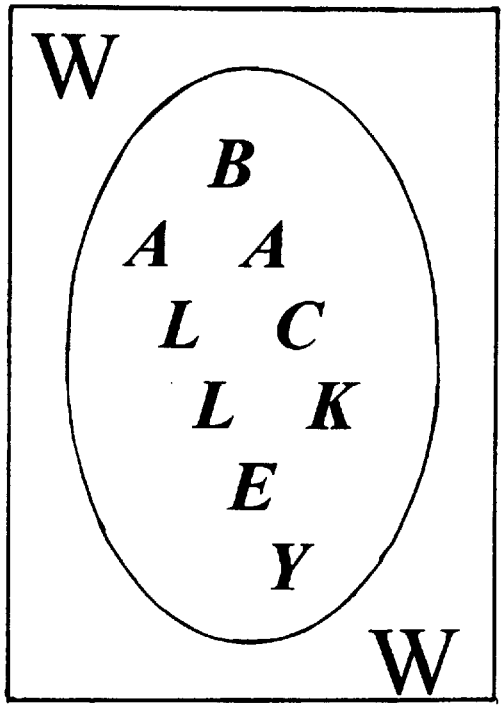
FIG. 14 is a front side view of the "Wild Back Alley" card (W) of the invention used in playing the game. There are four of these cards.
Figure 15:
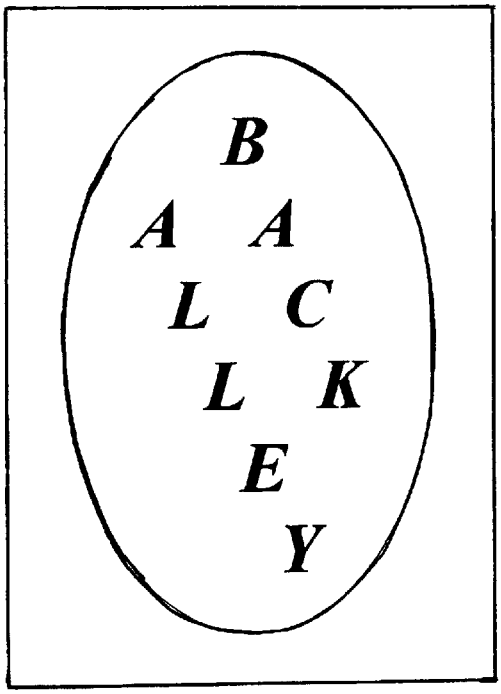
FIG. 15 is a back side view of all cards in FIGS. 1–14 of the invention used in playing the game.

4 "Wild" Back Alley cards (Refer to FIG. 14)

A box for storage.

While there has been shown and described the components required for the card game Back Alley, of this invention, it is understood that decisions concerning the precise materials used to manufacture the game components can be made by those skilled in the art without departing from the invention. Furthermore, where there has been shown and described the color, art, or design required for the card game Back Alley, of this invention, it is understood that decisions concerning the precise color, art, or design used in developing the game can be made by those skilled in the art without departing from the invention. The invention is defined in the following claim.

I claim:

1. A method of playing a card game with a plurality of players comprising the steps of:

a) providing a deck of 56 cards, 52 of the cards of the deck having a suit indicia, dividing said 52 cards into four different suits, said 52 cards having a numerical indicia wherein each suit having 13 cards numbered from 1 to 13 respectively, said deck of 56 cards further comprising 4 wild cards distinguishable from said 52 cards;

b) beginning a round by dealing a first hand of 13 cards to each player;

c) placing the remaining undealt cards in a pile face down in a central area;

d) each player bidding on a number of tricks they believe may be taken with their hand;

e) a player beginning a trick by playing a lead card wherein the player removing a card of any number of any suit from the player's hand and placing it face up in the central area, then each of the other players in turn playing one card from their hand following suit of the lead card if possible, after each player has played a card, the player that played a card with the highest numerical value of the same suit as the lead card, takes a trick by taking all the cards played;

f) repeating step e) until each player has played all the cards in their hand and all the tricks have been taken;

g) completing the round by calculating and recording each player's score by recording each player's bid and recording each player's tricks taken;

h) beginning another round by dealing a hand of cards to each player, the number of cards dealt in each player's hand being one less than the number of cards dealt to each player's hand in the previous round;

I) repeating steps c) through h) until the 13th round, wherein a hand of only one card is dealt to each player, is completed, then;

j) beginning another round by dealing a hand of only one card to each player, and repeating steps c) through g), then;

k) beginning another round by dealing a hand of cards to each player, the number of cards dealt in each player's hand being one more than the number of cards dealt to each player's hand in the previous round, and repeating steps c) through g) and k) until the 26th round, wherein a hand of 13 cards are dealt to each player, is completed, then;

l) totaling the scores of each player in all 26 rounds to determine a winner.

* * * * *